US005672219A

United States Patent [19]

Rinaldi et al.

[11] Patent Number: 5,672,219

[45] Date of Patent: Sep. 30, 1997

[54] PRINTING MIXTURE CONTAINING NO TOXIC MATERIALS, AND CARTRIDGE PERCUSSION PRIMER EMPLOYING SUCH A MIXTURE

[75] Inventors: Sergio Rinaldi, Livorno; Francesco Talini, Campo Tizzoro, both of Italy

[73] Assignee: Europa Metalli - Sezione Difesa Se.Di. S.p.A., Florence, Italy

[21] Appl. No.: 718,290

[22] Filed: Sep. 20, 1996

Related U.S. Application Data

[63] Continuation of Ser. No. 500,165, Jul. 11, 1995, abandoned.

[30] Foreign Application Priority Data

Jan. 5, 1994 [IT] Italy ..... T094A0578

[51] Int. Cl.[6] ..... C06B 33/00

[52] U.S. Cl. ..... 149/37; 149/23; 149/22

[58] Field of Search ..... 149/23, 37, 22

[56] References Cited

U.S. PATENT DOCUMENTS

| | | | |
|---|---|---|---|
| 4,050,347 | 9/1977 | Adelman et al. | 86/20 R |
| 4,105,480 | 8/1978 | Sterling et al. | 149/37 |
| 4,419,153 | 12/1983 | Boberg | 149/22 |
| 4,581,082 | 4/1986 | Hagel et al. | 149/27 |
| 4,675,059 | 6/1987 | Mei . | |
| 4,963,201 | 10/1990 | Bierke et al. . | |
| 5,145,106 | 9/1992 | Moore . | |
| 5,167,736 | 12/1992 | Mei et al. | 149/22 |
| 5,353,707 | 10/1994 | Duguet | 102/290 |
| 5,385,098 | 1/1995 | Lindquist et al. | 102/205 |
| 5,388,519 | 2/1995 | Guindon et al. | 102/292 |
| 5,417,160 | 5/1995 | Mei et al. | 102/289 |
| 5,427,031 | 6/1995 | Bowman | 102/331 |

FOREIGN PATENT DOCUMENTS

| | | |
|---|---|---|
| 0334735 | 3/1969 | France . |
| 0580486 | 1/1994 | France . |
| 2084984 | 4/1982 | United Kingdom . |

OTHER PUBLICATIONS

Explosives Edition 4, 1993 p. 104 J. Kohler, et al.

Webster's 3rd New World Dictionary pp. 637, 1684, 2225, 2373.

Concise Science Dictionary, Oxford Reference pp. 496, 513.

Encyclopedia of Explosives p. 051, vol. 8 PATR2700 U.S. Army Res.

Fluka Brochure 1995–1996 p. 1461.

Condensed Chemical Dictionary, 9th Ed., G. G. Hawley, Ed., Van Nostrand 1977.

*Primary Examiner*—Charles T. Jordan

*Assistant Examiner*—John R. Hardee

*Attorney, Agent, or Firm*—Ladas & Parry

[57] ABSTRACT

A priming mixture containing no toxic materials, in particular no Pb, Ba or Sb compounds, and presenting at least one primary explosive, an oxidizing agent, a reducing agent, and an inert friction agent; the oxidizing agent consisting essentially of stannic oxide, $SnO_2$. The central-fire or rimfire percussion primer presents a casing containing the priming mixture, and, in the case of the central-fire primer, also an anvil.

17 Claims, No Drawings

PRINTING MIXTURE CONTAINING NO TOXIC MATERIALS, AND CARTRIDGE PERCUSSION PRIMER EMPLOYING SUCH A MIXTURE

This application is a continuation of application Ser. No. 08/500,165 filed Jul. 11, 1995 now abandoned.

BACKGROUND OF THE INVENTION

The present invention relates to a priming mixture containing no toxic materials, in particular Pb, Ba and Sb compounds, and more specifically to a priming mixture of the above type comprising at least one primary explosive, an oxidizing agent, a reducing agent and, optionally, an inert friction agent and a secondary explosive. The present invention also relates to a primer for center-fire or rimfire percussion cartridges and including such a mixture.

As is known, the projectile propelling charge of a firearm is initiated by a percussion cap or primer. Until the late 50s, the priming mixture in the caps mainly comprised mercury fulminate, antimony trisulfide and potassium chlorate, but was later abandoned in favor of lead styphnate based mixtures containing barium (Ba) and antimony (Sb) compounds, which had the advantage of being slightly less toxic and, above all, of generating no reaction products reacting electrochemically with and so corroding the steel of which the firearms are made.

Increasingly strict pollution control, however, has now lowered the maximum concentration in the air of elements such as Pb, Sb, Ba to 0.1–0.5 mg/m$^3$ (depending on the element and whether it is in the form of fumes, powder, etc.), whereas the Pb concentration, for example, of target ranges, particularly indoor with forced ventilation systems, has been found to be many times the above limit.

As a result, numerous "ecological" priming mixture compositions, i.e. containing none of the above pollutant elements, have been devised. European Patent number 0012081 relates to a composition featuring a primary explosive—i.e. sensitive to shock and heat, and presenting a high flame propagation rate—with a negative oxygen content (diazodinitrophenol) combined with an oxidizing agent of zinc peroxide. The latter compound, however, is difficult to obtain in the pure state and is expensive, while the mixture itself would appear to be less sensitive at low temperature. U.S. Pat. No. 4,675,059 also relates to the same type of priming composition—i.e. a primary explosive, such as diazodinitrophenol, combined with an oxidizing agent—except that, in this case, the oxidizing agent comprises manganese dioxide, which cannot strictly be said to be nontoxic since it is limited to a maximum permissible concentration in the air of 5 mg/m$^3$. Finally, European Patent number 0334725 again relates to the same type of priming mixture, but again featuring a not entirely nontoxic oxidizing agent of copper oxide, the fumes of which are limited to a concentration in the air of 0.2 mg/m$^3$, i.e. to much the same value as for Pb, Sb and Ba. Moreover, the ballistic efficiency of all the above mixtures is not always comparable to that of traditional Pb mixtures.

SUMMARY OF THE INVENTION

It is an object of the present invention to provide a priming mixture composition which, while maintaining the ballistic efficiency of known Pb styphnate based mixtures, contains no Pb, Ba or Sb compounds, and is less toxic (in terms of the amount of pollutant powder/fumes produced in the air) as compared with most of the mixtures so far devised in lieu of traditional Pb mixtures.

According to the present invention, there is provided a priming mixture containing no toxic materials, in particular no Pb, Ba, Sb compounds, and comprising at least one primary explosive, an oxidizing agent, and at least one reducing agent; characterized in that said oxidizing agent comprises stannic oxide $SnO_2$.

The priming mixture according to a preferred embodiment of the present invention also comprises at least one secondary explosive; at least one friction agent comprising inert abrasive powder; and a binding agent.

More specifically, the oxidizing agent comprises exclusively stannic oxide; and the priming mixture composition according to the invention may range between: 20 to 60% by weight of primary explosive; 3 to 15% by weight of secondary explosive; 20 to 40% by weight of stannic oxide; 3 to 15% by weight of reducing agents; 5 to 25% by weight of friction agents; and 1 to 5% by weight of binding agent.

The primary explosive is selected from the group comprising diazodinitrophenol, tetrazene, nitromannitol, KDNBF, and mixtures thereof; while the secondary explosive comprises pentaerythritol tetranitrate.

The friction agent is selected from the group comprising calcium silicide, silicon monoxide, glass powder, and mixtures thereof; the reducing agent is selected from the group comprising aluminum powder, titanium powder, zirconium powder, boron powder, and mixtures thereof; and the binding agent is preferably gum arabic.

The priming mixture according to the present invention has surprisingly been found to present a ballistic efficiency fully comparable to that of traditional Pb styphnate mixtures, except that it is slightly less sensitive, though fully within NATO standard limits.

On the other hand, the priming mixture according to the invention functions excellently even at low temperatures, so much so as to conform with NATO AC225 standards, and may therefore be used not only for practice or target range cartridges, like most known "ecological" primer compositions, but also for combat ammunition.

DETAILED DESCRIPTION OF THE INVENTION

A number of non-limiting embodiments of the present invention will now be described by way of example.

EXAMPLE 1

150 gr of a priming mixture of the following composition are prepared:

- 65 gr of damp (24% humidity) diazodinitrophenol, equivalent to 49.5 gr of dry product;
- 39 gr of 99.9% pure commercial stannic oxide $SnO_2$ supplied by FISA, Pietrasanta (LU);
- 22.5 gr of tetrazene;
- 22.5 gr of calcium silicide with over 65% of the grains below 44 micron and none over 149 micron;
- 7.5 gr of pentaerythritol tetranitrate;
- 7.5 gr of aluminium powder by POMENTON S.p.A. of Venice (average grain size<100 micron);
- 1.5 gr of gum arabic.

The above products are mixed as follows: the nonexplosive components in the dry state are first mixed together; to this are added the explosive components (DDNP, tetrazene and pentaerythritol tetranitrate) maintained at such a humidity that the final humidity of the mixture ranges between 10 and 15% by weight; the resulting product is metered into primers comprising center-fire percussion caps for NATO 5.56 mm caliber cartridges, each comprising a cap and relative anvil and containing roughly 0.018 gr of the prepared mixture; and the primers are then fitted in known manner to the above cartridges.

Using a damp mixture enables it to be metered more easily into the caps, and provides for maximum safety when preparing and processing the primers.

EXAMPLE 2

The cartridges prepared as in Example 1 were comparison tested with others of the same type featuring traditional primers of the same type but containing a traditional Pb styphnate priming mixture consisting of a commercial product manufactured by the Applicant. Testing comprised an EPVAT and sensitivity test, both performed according to the NATO AC225 standard manual, and the results of which are shown respectively in Tables 1 and 2.

As shown clearly in Tables 1 and 2, the priming mixture prepared as in Example 1 and within the limit values of the invention presents a ballistic efficiency fully comparable with the traditional Pb styphnate mixture. The mixture according to the invention, however, contains absolutely no components currently classed as harmful pollutants, and as such constitutes an effective and, at the same time, truly ecological priming mixture. What is more, the ballistic efficiency of the mixture according to the invention remains high, and within the strict NATO limits governing this type of test, even at low temperature.

The sensitivity test also shows that, though slightly less sensitive as compared with the traditional Pb styphnate mixture, the mixture according to the invention nevertheless still conforms with strict NATO standards as per AC225.

TABLE 1

| N° shots | Ref. | Test cartridges | | |
|---|---|---|---|---|
| + cond. | 20 + 21° C. | 30 +21° C. | 30 +52° C. | 6 −54° C. |
| Medium Pn (MPa) | 340,5 | 314,2 | 327,7 | 280,5 |
| SD | 6,2 | 4,9 | | |
| Medium Pm (MPa) | 96,8 | 93,8 | 94,9 | 95,8 |
| SD | 1,261 | 0,832 | 0,763 | |
| Medium V24 (m/sec) | 915,6 | 906,8 | 913,4 | 878,1 |
| SD | 3,2 | 3 | 0,763 | |
| Medium AT (μsec) | 1255 | 1399 | 1341 | 1506 |
| SD | 83,5 | 72,4 | | |

Pn = neck pressure
Pm = muzzle pressure
V24 = projectile velocity at 24 m
AT = action time
SD = standard deflection

TABLE 2

| Drop height mm | Primers fired n° | Failed Primers n° |
|---|---|---|
| 130 | 0 | 50 |
| 155 | 1 | 49 |
| 180 | 13 | 39 |
| 205 | 31 | 19 |
| 230 | 38 | 12 |
| 255 | 47 | 3 |

TABLE 2-continued

| Drop height mm | Primers fired n° | Failed Primers n° |
|---|---|---|
| 280 | 49 | 1 |
| 305 | 50 | 0 |

100% failure height = 130 mm
H (50% failure) = 203 mm (calculated)
S (standard deflection) = 32.44
H+5S = 365.19 (<450 acceptable)
H−2S = 138.12 (>75 acceptable)

We claim:

1. A priming mixture containing no toxic metal containing compounds, including no Pb, Ba, Sb compounds, and comprising at least one primary explosive; an oxidizing agent; and at least one reducing agent; wherein said oxidizing agent consists essentially of stannic oxide $SNO_2$.

2. A priming mixture as claimed in claim 1, wherein the mixture also comprises at least one secondary explosive; and at least one friction agent comprising inert abrasive powder.

3. A priming mixture as claimed in claim 1, wherein the mixture also comprises a binding agent.

4. A priming mixture as claimed in claim 1, wherein the mixture comprises 20 to 60% by weight of primary explosive; 3 to 15% by weight of secondary explosive; 20 to 40% by weight of stannic oxide; 3 to 15% by weight of reducing agents; 5 to 25% by weight of friction agents; and 1 to 5% by weight of binding agent.

5. A priming mixture as claimed in claim 4, wherein said primary explosive is selected from the group consisting of diazodinitrophenol, tetrazene, nitromannitol, KDNBF, and mixtures thereof.

6. A priming mixture as claimed in claim 4, wherein said secondary explosive comprises pentaerythritol tetranitrate.

7. A priming mixture as claimed in claim 4, wherein said friction agent is selected from the group consisting of calcium silicide, silicon dioxide, glass powder, and mixtures thereof.

8. A priming mixture as claimed in claim 4, wherein said reducing agent is selected from the group consisting of aluminum powder, titanium powder, zirconium powder, boron powder, and mixtures thereof.

9. A priming mixture as claimed in claim 4, wherein said binding agent comprises gum arabic.

10. A percussion primer for center-fire or rimfire percussion cartridges, comprising a priming mixture as claimed in claim 1.

11. In a mixture for priming a percussion charge wherein a primary explosive that is sensitive to shock and heat and provides a high flame propagation rate is present in admixture with an oxidizing agent and a reducing agent, said primary explosive, oxidizing agent and reducing agent being present in the mixture in respective amounts such that the mixture is effective for priming the percussion charge, the improvement wherein the oxidizing agent consists essentially of stannic oxide and the mixture is free of compounds containing Pb, Ba, or Sb.

12. A mixture as claimed in claim 11, wherein the mixture is also free of manganese dioxide and copper oxide.

13. A mixture as claimed in claim 12, wherein the mixture also comprises at least one secondary explosive; and at least one friction agent comprising inert abrasive powder.

14. A mixture as claimed in claim 13, wherein the mixture comprises 20 to 60% by weight of the primary explosive; 3 to 15% by weight of the secondary explosive; 20 to 40% by weight of the stannic oxide; 3 to 15% by weight of the reducing agent; 5 to 25% by weight of the friction agent; and 1 to 5% by weight of a binding agent.

15. A mixture as claimed in claim 14, wherein said primary explosive is selected from the group consisting of diazodinitrophenol, tetrazene, nitromannitol, KDNBF, and mixtures thereof.

16. A mixture as claimed in claim 15, wherein the secondary explosive comprises pentaerythritol tetranitrate.

17. A mixture as claimed in claim 16, wherein the reducing agent is selected from the group consisting of aluminum powder, titanium powder, zirconium powder, boron powder, and mixtures thereof, and the binding agent comprises gum arabic.

* * * * *

UNITED STATES PATENT AND TRADEMARK OFFICE

CERTIFICATE OF CORRECTION

PATENT NO. : 5,672,219

DATED : September 30, 1997

INVENTOR(S) : Sergio Rinaldi et al.

It is certified that error appears in the above-identified patent and that said Letters Patent is hereby corrected as shown below:

On the title page, item [54] "PRINTING" should be --PRIMING-- and item [30] "January 5, " should be --July 15, --. Column 1, "PRINTING" should be --PRIMING--.

Signed and Sealed this

Twenty-second Day of September, 1998

*Attest:*

Bruce Lehman

BRUCE LEHMAN

*Attesting Officer*

*Commissioner of Patents and Trademarks*